US009728363B2

(12) United States Patent
Carnick et al.

(10) Patent No.: US 9,728,363 B2
(45) Date of Patent: Aug. 8, 2017

(54) PRE-FUSE ASSEMBLY WITH HORIZONTAL JUMP POST

(71) Applicant: SUMITOMO ELECTRIC WIRING SYSTEMS, INC., Bowling Green, KY (US)

(72) Inventors: Brian Carnick, New Baltimore, MI (US); Bennie James Malcom, Detroit, MI (US)

(73) Assignee: Sumitomo Wiring Systems, Ltd., Yokkaichi, Mie (JP)

( * ) Notice: Subject to any disclaimer, the term of this patent is extended or adjusted under 35 U.S.C. 154(b) by 7 days.

(21) Appl. No.: 14/952,198

(22) Filed: Nov. 25, 2015

(65) Prior Publication Data

US 2017/0148600 A1 May 25, 2017

(51) Int. Cl.

| | |
|---|---|
| ***H01H 85/02*** | (2006.01) |
| ***H01H 85/055*** | (2006.01) |
| ***H01R 11/28*** | (2006.01) |

(52) U.S. Cl.

CPC ..... *H01H 85/0241* (2013.01); *H01H 85/055* (2013.01); *H01R 11/281* (2013.01); *H01H 2085/025* (2013.01); *H01H 2231/026* (2013.01)

(58) Field of Classification Search

CPC ..... H01H 85/0241; H01H 85/055; H01H 2085/025; H01H 2231/026; H01R 11/281

USPC ..... 337/189

See application file for complete search history.

(56) References Cited

U.S. PATENT DOCUMENTS

| | | | | |
|---|---|---|---|---|
| 5,643,693 | A * | 7/1997 | Hill | H01M 2/348 429/121 |
| 5,785,532 | A * | 7/1998 | Maue | B60R 16/0238 439/34 |
| 6,679,708 | B1 | 1/2004 | Depp | |
| 7,361,841 | B1 * | 4/2008 | Smolen | H01R 4/70 174/135 |
| 7,499,262 | B1 * | 3/2009 | Darr | H01R 9/226 361/626 |

(Continued)

FOREIGN PATENT DOCUMENTS

| | | |
|---|---|---|
| JP | 10-322851 A | 4/1998 |
| JP | 2004134278 A | 4/2004 |

(Continued)

OTHER PUBLICATIONS

International Search Report for Application No. PCT/US2016/063239 dated Mar. 14, 2017, 3 pages.

*Primary Examiner* — Anatoly Vortman

(74) *Attorney, Agent, or Firm* — Reising Ethington, P.C.

(57) ABSTRACT

A pre-fuse assembly designed to protect certain components within a vehicle electrical system against short circuits and to provide a user with easy access to a jump post for jump starting a dead battery. The pre-fuse assembly is a current-limiting electrical device that is mounted on top of the vehicle battery and includes fuses for limiting the current from the vehicle battery to a power distribution device and includes a horizontal jump post for providing easy access when jump starting a dead battery without increasing the overall height of the device. In one embodiment, the pre-fuse assembly includes a lower housing, an upper housing, a battery post connector, a master fuse, a fastener, a horizontal jump post and any number of other components.

20 Claims, 2 Drawing Sheets

(56) References Cited

U.S. PATENT DOCUMENTS

| | | | | |
|---|---|---|---|---|
| 8,395,061 | B2 * | 3/2013 | Asao | H02G 3/16 174/50 |
| 2006/0003627 | A1 * | 1/2006 | Freitag | H01R 13/68 439/504 |
| 2008/0149387 | A1 | 6/2008 | Oda | |
| 2012/0064741 | A1 | 3/2012 | Kawaguchi | |
| 2016/0196947 | A1 | 7/2016 | Matsumoto | |

FOREIGN PATENT DOCUMENTS

| | | | |
|---|---|---|---|
| JP | 2014103077 | A | 6/2014 |
| JP | 2015060810 | A | 3/2015 |
| JP | 2016131094 | A | 7/2016 |

* cited by examiner

PRE-FUSE ASSEMBLY WITH HORIZONTAL JUMP POST

FIELD

The present invention relates generally to a vehicle electrical system and, more specifically, to a pre-fuse assembly that is mounted on top of a vehicle battery and provides access for jumper cables.

BACKGROUND

All vehicle batteries have a pair of terminals or poles, a positive terminal which is typically red and a negative terminal which is typically black. In the event that the battery becomes low on charge and will not start the vehicle (a so-called "dead" battery), the vehicle may need to be jump started using a separate booster battery. A first jumper cable is used to connect the positive terminals of the dead and booster batteries together, while a second jumper cable is used to connect the negative terminals of the dead and booster batteries together, oftentimes through a commonly grounded chassis component of the vehicle.

In order to ease the jump starting process, some vehicle batteries have a vertically extending jump post that is electrically connected to the positive terminal of the battery and provides a user with a post or terminal to which they can easily clamp one end of a jumper cable. A vertical jump post extending directly from a positive battery terminal may be conveniently located for the user, but it can present issues in terms of packaging height and does not necessarily allow for the use of a pre-fuse assembly, which is a current-limiting electrical device that typically sits on top of the battery where the vertical jump post would be.

Thus, it may be beneficial to provide a pre-fuse assembly that both satisfies packaging height requirements and has a conveniently located jump post for the user.

SUMMARY

According to one aspect, there is provided a pre-fuse assembly for mounting on top of a vehicle battery. The pre-fuse assembly comprises: a lower housing; an upper housing; a battery post connector at least partially installed between the lower and upper housings, the battery post connector is a metal connector that is configured for electrical connection to a terminal of the vehicle battery; a master fuse at least partially installed between the lower and upper housings, the master fuse is a current-limiting component that is electrically connected to the battery post connector; and a horizontal jump post at least partially extending from the lower or upper housings, the horizontal jump post is an electrical terminal configured for engagement by a jumper cable and is electrically connected to the master fuse. The pre-fuse assembly is configured for mounting on top of the vehicle battery.

DRAWINGS

Preferred exemplary embodiments of the invention will hereinafter be described in conjunction with the appended drawings, wherein like designations denote like elements, and wherein:

FIGS. 6 and 7 are enlarged perspective views of an exemplary fastener and jump post that may be a part of the pre-fuse assembly of FIG. 1, wherein FIG. 6 shows the fastener and jump post being attached to the master fuse and FIG. 7 shows the fastener and jump post alone.

DESCRIPTION

There is described herein a pre-fuse assembly 10 that is designed to protect certain components within a vehicle electrical system against short circuits and to provide a user with easy access to a jump post for jump starting a dead battery. The pre-fuse assembly 10 is a current-limiting electrical device that is mounted on top of the vehicle battery 12 and includes a number of fuses or other elements for limiting the current flowing from the vehicle battery to a power distribution device and includes a horizontal jump post for providing easy access when jump starting a dead battery. Because the pre-fuse assembly 10 is mounted directly on top of the vehicle battery 12, as opposed to being located away from the battery, there is no need for the rather substantial sized cable that would otherwise be required to handle the current flow from the battery to the pre-fuse assembly.

Figure 1:
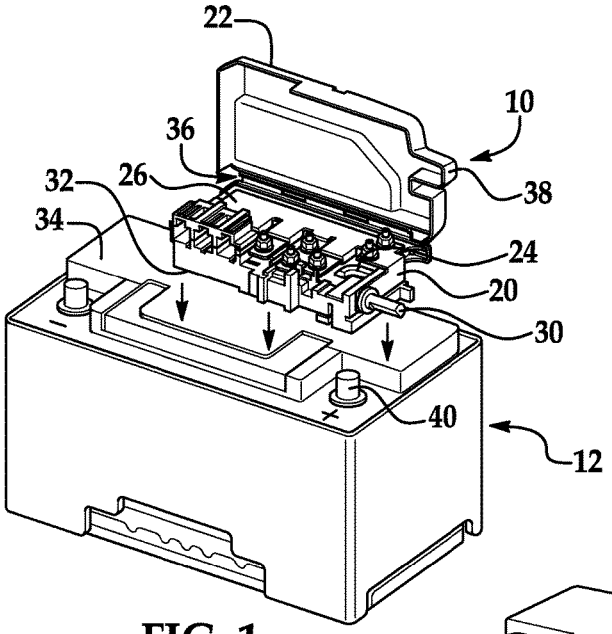
FIG. 1 is a perspective view of an exemplary pre-fuse assembly before it is mounted on top of a vehicle battery.
Figure 2:
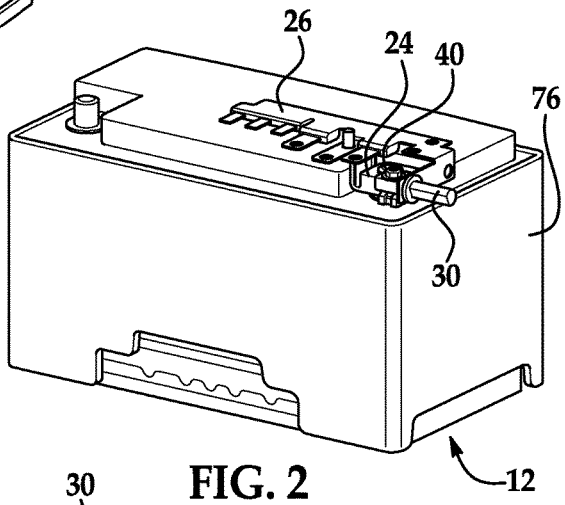
FIG. 2 is a perspective view of the exemplary pre-fuse assembly of FIG. 1 after it is mounted on top the vehicle battery, but with the upper and lower housings removed for better visibility of the other pre-fuse assembly parts.
Figure 3:
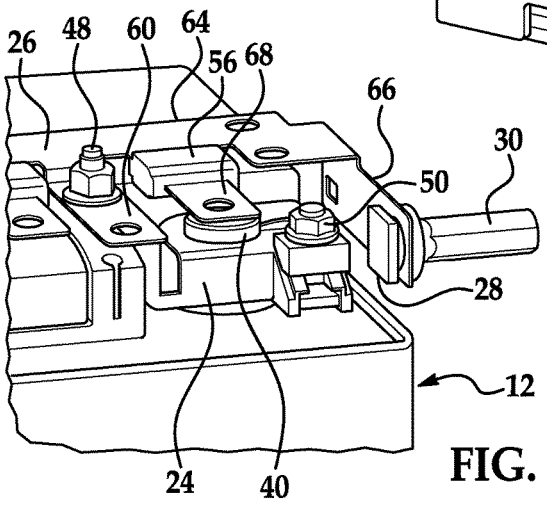
FIG. 3 is an enlarged perspective view of a portion of the exemplary pre-fuse assembly of FIG. 1 after it is mounted on top the vehicle battery, but with the upper and lower housings removed for better visibility of the other pre-fuse assembly parts.

Turning now to FIG. 1, the pre-fuse assembly 10, also known as a pre-fuse box or a battery fuse terminal, includes a lower housing 20, an upper housing 22, a battery post connector 24, a master fuse 26, a fastener 28, a jump post 30 and any number of other components. FIG. 1 shows the pre-fuse assembly 10 before it is installed on top of the vehicle battery 12 in the vicinity of a positive battery terminal 40, whereas FIGS. 2 and 3 show the pre-fuse assembly installed but with the upper and lower housings 20, 22 removed for better visibility of some of the other components.

The lower and upper housings 20, 22 are housing pieces that help maintain the various components of the pre-fuse assembly in place and electrically isolate some of those components so that they do not short circuit. In the non-limiting example illustrated in FIG. 1, the lower housing 20 is a block-shaped component that is molded from an electrically insulative plastic material and includes slots, recesses, bosses, etc. for maintaining the battery post connector 24, the master fuse 26, and any number of other components in their proper position and orientation. An under side or under surface 32 of the lower housing 20 is configured to contact an upper side or upper surface 34 of the vehicle battery 12 such that the pre-fuse assembly 12 sits on top of and is directed mounted to the battery. The upper housing 22 is also made of an insulative plastic material and may pivotally attach to the lower housing 20 along a hinged side 36 so that a user or service technician can open and close the upper housing and gain access to the interior components of the pre-fuse assembly 10. The upper housing 22 may also include a jump-post cover 38 that can pivot between a closed position where it is overtop of and covering a horizontal jump post 30 and an opened position where it is pivoted up and out of the way so as to give a user with jump cables access thereto. It should be appreciated that the lower and upper housings 20, 22 are simply provided for purposes of illustration and that other housings, including ones that are significantly different than those shown here, could be used.

Figure 4:
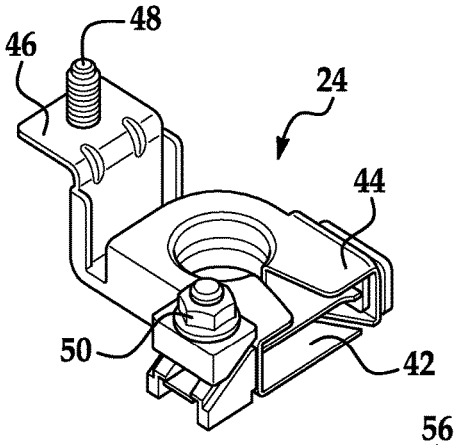
FIG. 4 is an enlarged perspective view of an exemplary battery post connector that may be a part of the pre-fuse assembly of FIG. 1.

The battery post connector 24 is a connector piece that is at least partially installed or located within the lower housing 20 and is designed to securely fit over top of a positive battery terminal 40 such that an electrical connection is made therebetween. The battery post connector 24 can either be a single- or multi-piece component that is made of a conductive metal or metal alloy and includes a lower contact portion 42, an upper contact portion 44, a neck portion 46 and a threaded stud 48. As best illustrated in FIGS. 3-4, the lower and upper contact portions 42, 44 are designed to circumferentially surround and make physical and electrical contact with the positive battery terminal 40. The lower and upper contact portions 42, 44 can be stamped or otherwise metal formed from different pieces of metal and then securely attached to one another vie a fastener 50 of some type; or they can simply be formed from a single piece of metal, in which case the fastener would be unnecessary. It should be appreciated that once the battery post connector 24 is installed within the pre-fuse assembly 10, it may be largely encased or surrounded by the lower housing 20 with openings to provide access for and to the positive battery terminal 40 (this is why the batter post connector 24 is largely obstructed in FIG. 1). The neck portion 46 extends away from the central body of the battery post connector 24 and includes a flat segment from which the threaded stud 48 extends. In the example shown in FIG. 4, the neck portion 46 includes two 90° bends and has a flat segment that is generally parallel to the lower and upper contact portions 42, 44 so that the threaded stud 48 can extend upwards therefrom in a vertical manner. Of course, other battery post connectors could be used instead, as the illustrated embodiment is just one example.

Figure 5:
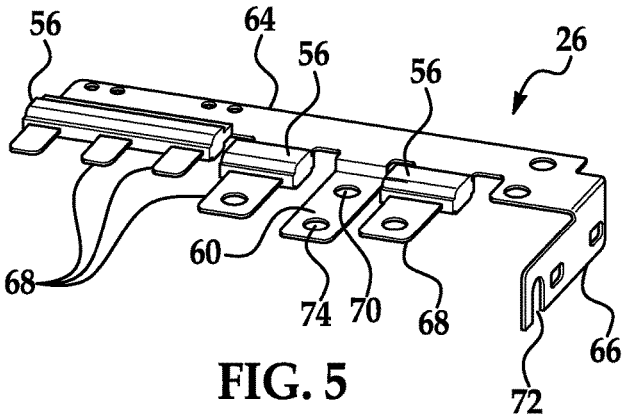
FIG. 5 is an enlarged perspective view of an exemplary master fuse that may be a part of the pre-fuse assembly of FIG. 1.
Figure 6:
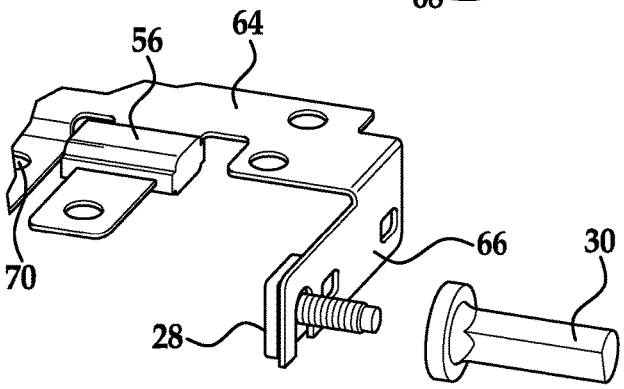
Figure 7:
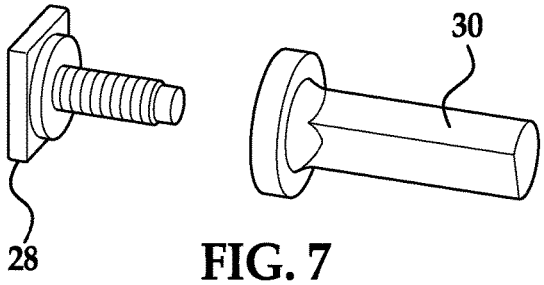

The master fuse 26 is attached to a top surface of the lower housing 20 and is bolted to the battery post connector 24 such that they are in electrical connection with one another. The master fuse 26 may be stamped or otherwise formed from a conductive metal or metal alloy, and may include one or more integrated fuse elements 56 (e.g., a fusable link built into the master fuse) that are designed to limit the amount of current or amperage in the system. In addition to the fuse elements 56, the master fuse 26 includes a battery connection portion 60, a main body portion 64, a jump post connection portion 66, and a number of additional connection portions or tabs 68. As best demonstrated in FIGS. 3 and 5, the battery connection portion 60 includes an opening 70 for fitting over top of the vertically extending threaded post 48 of the battery post connector 24 so that the master fuse 26 can be physically and electrically connected to the battery post connector 24. The jump post connection portion 66 bends down and away from the main body portion 64 and includes an opening 72 for receiving the fastener 28 and jump post 30. The additional connection portions 68 are used to connect the master fuse to various electrical devices in the vehicle, such as high current devices like an alternator, a radiator fan, etc. and each of these additional connection portions may include a fuse element 56 to protect such devices from excessive current. Battery connection portion 60 includes two holes or openings: a first opening 70 that fits over the threaded post 48, as already described, and a second opening 74 that connects with a terminal that leads to a power distribution device, such as a power distribution box (PDB), an electrical connection box, a power center, etc. As illustrated, the battery connection portion 60 does not have an integrated fuse element like some of the additional connection portions 68, but this is taken into account by the power distribution device which has its own internal current-limiting features. It should be appreciated that the master fuse depicted in the drawings is only for purposes of illustration and that other designs and configurations, including ones that are significantly different, could be used.

The fastener 28, which is shown here in the form of a bolt, is threaded into an internal bore in the jump post 30 and compresses the jump post connection portion 66 therebetween so that the jump post is securely fastened to the master fuse 26 and, hence, the overall assembly. It will be appreciated from the drawings that jump post 30 is a horizontally aligned jump post, which reduces the overall packaging height of the pre-fuse assembly 10 and can help ease some of the tight dimensional requirements that oftentimes accompany such assemblies. The jump post 30 is generally cylindrical, but has a hex-like cross-sectional shape that allows for easy and convenient attachment by a jumper cable terminal. It is not necessary for the pre-fuse assembly 10 to utilize the exact fastener and jump post configuration that is shown. For example, the jump post 30 could have a threaded stud extending from its attachment end, instead of having a threaded internal bore, which could then be inserted into a threaded hole in the jump post connection 66 or a threaded nut on the other side, to cite two examples. In another possible embodiment, the jump post 30 could be directly attached to the battery post connector 24 or some other component, as opposed to being directly attached to the master fuse 26. Other embodiments are certainly possible.

The horizontal orientation of the jump post 30 makes the component convenient and easy for a user with jumper cables to access, as the jump post extends out and away from the rest of the pre-fuse assembly 10 so as to give plenty of clearance for the jumper cables. The particular configuration and arrangement of the jump post 30 is somewhat unique in that it is both part of a pre-fuse assembly (many such components are not integrated within a pre-fuse assembly) and it extends in a generally horizontal manner, so as to reduce the overall packaging height of the pre-fuse assembly. In order to properly connect the jump post 30 and maintain its horizontal orientation, the jump post connection portion 66 is bent away from the main body portion 64 and presents a mounting surface for the jump post that is generally parallel to the side 76 of the battery 12 (i.e., jump post connection portion 66 is parallel to battery side 76). As already explained above, the upper housing 22 may include a jump-post cover 38 that can pivot between opened and closed positions to cover and protect the horizontally aligned jump post 30.

In operation, positive power or B+ power is provided from the battery 12, through the pre-fuse assembly 10, and onto various electrical components within the vehicle. More particularly, current flows from the battery positive terminal 40, through the battery post connector 24, across the interface between neck portion 46 and the battery connection portion 60, through the master fuse 26, including the various integrated fuse elements 56, and onto downstream electrical components such as a power distribution box (PDB) or a wiring harness, not shown. In the event of a short circuit, such as when the vehicle is involved in an accident, one or more of the fuse elements 56 will trip in response to a surge in current and thereby protect the downstream electrical components from being damaged. If the vehicle battery 12 is dead and needs to be jump started, then the user can simply attach the pair of jumper cables to the horizontal jump post 30 and a grounded element and jump start the vehicle with the use of a booster battery, as is widely understood in the art.

The pre-fuse assembly 10 advantageously combines a pre-fuse device and a jump post and in a manner that protects downstream electrical components in the vehicle, satisfies strict packaging height requirements for mounting such a device on top of a vehicle battery, provides a jump post that is convenient to use in the event that the vehicle battery is dead and needs to be jumped, and is easy to manufacture.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A pre-fuse assembly for mounting on top of a vehicle battery, comprising:

a lower housing;

an upper housing;

a battery post connector at least partially installed between the lower and upper housings, the battery post connector is a metal connector that is configured for electrical connection to a terminal of the vehicle battery, the battery post connector includes at least one contact portion, a neck portion, and a threaded stud, and the at least one contact portion is configured to fit over top of and circumferentially surround a positive terminal of the vehicle battery so that an electrical connection can be established between the positive terminal of the vehicle battery and the battery post connector;

a master fuse at least partially installed between the lower and upper housings, the master fuse is a current-limiting component that is electrically connected to the battery post connector; and a horizontal jump post at least partially extending from the lower or upper housings, the horizontal jump post is an electrical terminal configured for engagement by a jumper cable and is electrically connected to the master fuse;

wherein the pre-fuse assembly is configured for mounting on top of the vehicle battery.

2. The pre-fuse assembly of claim 1, wherein the lower housing is made of an insulative plastic material and includes an underside that is configured to contact an upper side of the vehicle battery so that the pre-fuse assembly can be directly mounted to the vehicle battery.

3. The pre-fuse assembly of claim 1, wherein the upper housing is made of an insulative plastic material and includes a hinged side that is configured to pivotally attach the upper housing to the lower housing so that the upper housing can be opened and closed and provide access to interior components of the pre-fuse assembly.

4. The pre-fuse assembly of claim 1, wherein the neck portion extends away from the at least one contact portion and includes a flat segment from which the threaded stud extends upwards in a vertical manner.

5. A pre-fuse assembly for mounting on top of a vehicle battery, comprising:

a lower housing;

an upper housing;

a battery post connector at least partially installed between the lower and upper housings, the battery post connector is a metal connector that is configured for electrical connection to a terminal of the vehicle battery;

a master fuse at least partially installed between the lower and upper housings, the master fuse is a current-limiting component that is electrically connected to the battery post connector, the master fuse includes a battery connection portion electrically connected to the battery post connector, a main body portion, a jump post connection portion, and a plurality of additional connection portions, and at least one of the main body portion or the additional connection portions includes a current-limiting fuse element; and a horizontal jump post at least partially extending from the lower or upper housings, the horizontal jump post is an electrical terminal configured for engagement by a jumper cable and is electrically connected to the master fuse;

wherein the pre-fuse assembly is configured for mounting on top of the vehicle battery.

6. The pre-fuse assembly of claim 5, wherein the battery connection portion includes an opening for receiving a threaded stud of the battery post connector so that the master fuse is electrically connected to the battery post connector.

7. The pre-fuse assembly of claim 5, wherein the battery connection portion includes an opening for receiving a terminal connected to a power distribution device so that the power distribution device is electrically connected to the master fuse.

8. The pre-fuse assembly of claim 5, wherein the main body portion extends the length of the master fuse and each of the battery connection portion, the jump post connection portion, and the plurality of additional connection portions perpendicularly extends from the main body portion in a finger-like manner.

9. The pre-fuse assembly of claim 5, wherein the jump post connection portion includes an opening for attachment of the horizontal jump post so that the horizontal jump post is electrically connected to the master fuse.

10. The pre-fuse assembly of claim 5, wherein the jump post connection portion is bent away from the main body portion and includes a mounting surface that is configured to be parallel to a side of the vehicle battery so that the horizontal jump post can extend horizontally and does not increase the overall height of the pre-fuse assembly.

11. The pre-fuse assembly of claim 5, wherein each of the plurality of additional connection portions is configured to electrically connect to an electrical device in the vehicle and has a current limiting fuse element.

12. The pre-fuse assembly of claim 11, wherein each of the current limiting fuse elements is embedded or integrated into an additional connection portion of the master fuse in the form of a fusable link.

13. The pre-fuse assembly of claim 5, wherein neither of the battery connection portion nor the jump post connection portion includes a current-limiting fuse element, and the plurality of additional connection portions include current-limiting fuse elements.

14. The pre-fuse assembly of claim 5, wherein the lower housing is made of an insulative plastic material and includes an underside that is configured to contact an upper side of the vehicle battery so that the pre-fuse assembly can be directly mounted to the vehicle battery.

15. The pre-fuse assembly of claim 5, wherein the upper housing is made of an insulative plastic material and includes a hinged side that is configured to pivotally attach the upper housing to the lower housing so that the upper housing can be opened and closed and provide access to interior components of the pre-fuse assembly.

16. A pre-fuse assembly for mounting on top of a vehicle battery, comprising:

a lower housing;

an upper housing;

a battery post connector at least partially installed between the lower and upper housings, the battery post connector is a metal connector that is configured for electrical connection to a terminal of the vehicle battery;

a master fuse at least partially installed between the lower and upper housings, the master fuse is a current-limiting component that is electrically connected to the battery post connector; and a horizontal jump post at least partially extending from the lower or upper housings, the horizontal jump post is an electrical terminal configured for engagement by a jumper cable and is electrically connected to the master fuse the horizontal jump post includes a base and a threaded interior bore for receiving a threaded fastener, and inserting the threaded fastener within the threaded interior bore causes the base and the fastener to compress a portion of the master fuse therebetween so that the horizontal jump post is electrically connected to the master fuse;

wherein the pre-fuse assembly is configured for mounting on top of the vehicle battery.

17. The pre-fuse assembly of claim 16, wherein the horizontal jump post extends outwardly from the lower housing so that it increases the overall width of the pre-fuse assembly but does not increase the height of the pre-fuse assembly.

18. The pre-fuse assembly of claim 16, wherein the pre-fuse assembly is configured to be electrically connected between a positive terminal of the vehicle battery and a power distribution device having a wiring harness.

19. The pre-fuse assembly of claim 16, wherein the lower housing is made of an insulative plastic material and includes an underside that is configured to contact an upper side of the vehicle battery so that the pre-fuse assembly can be directly mounted to the vehicle battery.

20. The pre-fuse assembly of claim 16, wherein the upper housing is made of an insulative plastic material and includes a hinged side that is configured to pivotally attach the upper housing to the lower housing so that the upper housing can be opened and closed and provide access to interior components of the pre-fuse assembly.

* * * * *